United States Patent [19]

Schagen

[11] 3,996,868

[45] Dec. 14, 1976

[54] WINDSURFER

[75] Inventor: Fritz Schagen, Rosspfad, Germany

[73] Assignee: Fa. Immobilien Commerce Estbl. Dr. Ivo Beck, Vaduz, Liechtenstein

[22] Filed: May 14, 1975

[21] Appl. No.: 577,464

[30] Foreign Application Priority Data

May 14, 1974 Germany ..... 2423251

[52] U.S. Cl. ..... 114/39; 9/2 S; 9/310 E

[51] Int. Cl.[2] ..... B63H 9/04

[58] Field of Search ..... 9/2 S, 2 R, 2 F, 310 R, 9/310 E, 310 C, 310 B; 114/39

[56] References Cited

UNITED STATES PATENTS

| | | | |
|---|---|---|---|
| 1,549,153 | 8/1925 | Scheff | 9/2 S |
| 2,415,495 | 2/1947 | Humphreys | 9/2 S |
| 3,041,994 | 7/1962 | Brodie | 114/39 |
| 3,150,385 | 9/1964 | Gerber et al. | 9/2 S |
| 3,287,754 | 11/1966 | Price et al. | 9/310 E |
| 3,409,920 | 11/1968 | Brownley | 9/310 E |
| 3,487,800 | 1/1970 | Schweitzer et al. | 114/39 |
| 3,883,909 | 5/1975 | Fisher et al. | 9/2 S |

FOREIGN PATENTS OR APPLICATIONS

| | | | |
|---|---|---|---|
| 407,491 | 3/1934 | United Kingdom | 9/2 S |

*Primary Examiner*—Trygve M. Blix
*Assistant Examiner*—Stuart M. Goldstein
*Attorney, Agent, or Firm*—Joseph A. Geiger

[57] ABSTRACT

A wind-propelled surfboard or aquaplane having a hull assembled of several separable hull sections which are longitudinally clamped together by means of tensioning cables extending inside two horizontally spaced longitudinal spine tubes. These tubes are joined by means of connecting sleeves, for a torsion-resistant connection between the hull sections.

5 Claims, 1 Drawing Figure

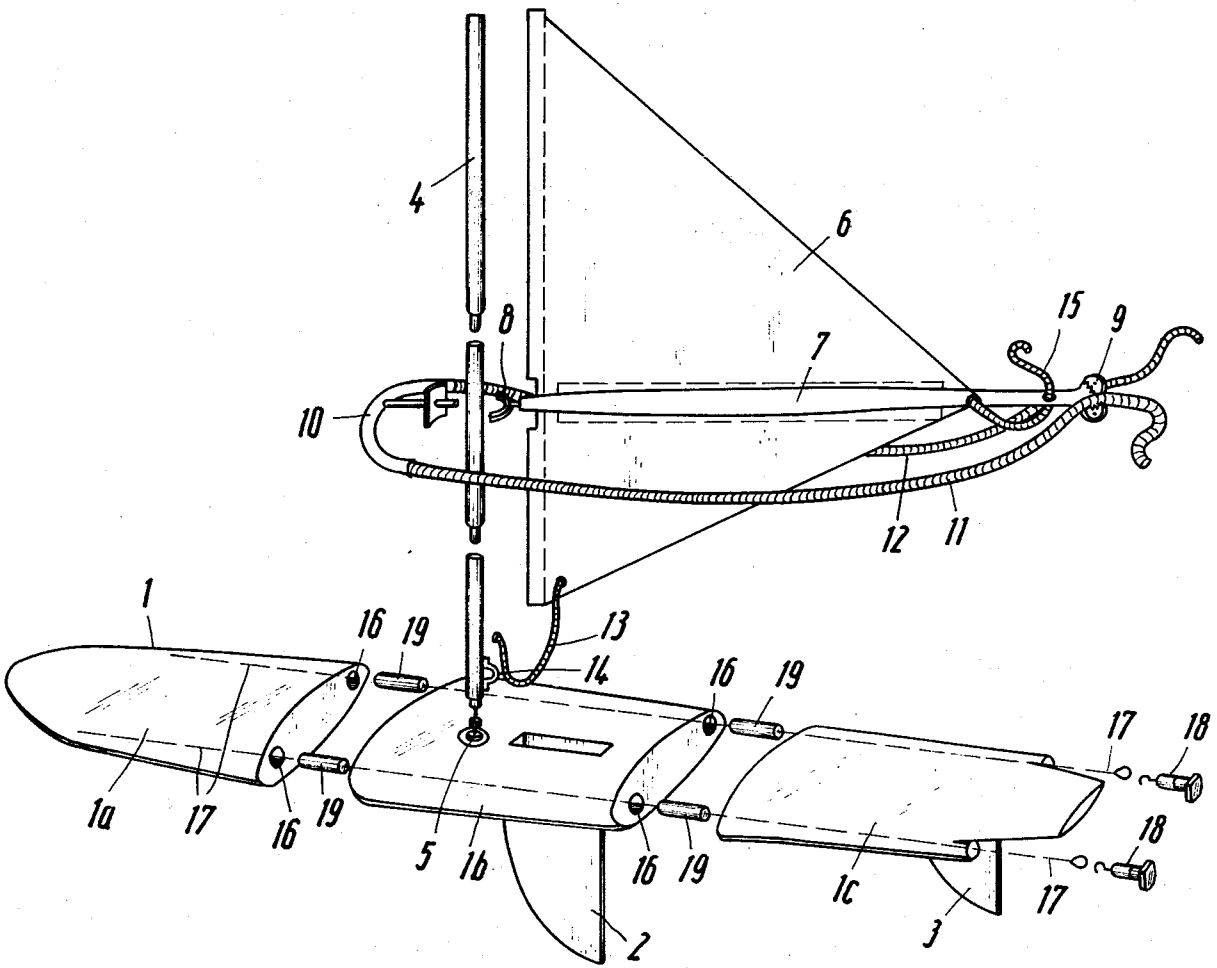
1
1a
1b
1c
2
3
4
5
6
7
8
9
10
11
12
13
14
15
16
17
18
19

WINDSURFER

BACKGROUND OF THE INVENTION

1. Field of the Invention

The present invention relates to surfing and navigating implements, and more particularly to navigatable, wind-propelled surfboards or aquaplanes with a mast and sail for propulsion.

2. Description of the Prior Art

Surfboards equipped with a mast and sail for propulsion are known from the prior art in this field. They normally have a hull molded of fiber glass or of some other suitable plastic material. Such a plastic hull may be composed of several hull sections which are permanently joined together, to form an integral one-piece hull construction. The hull for this type of surfboard is normally more than three meters long, which means that such a hull, though light in weight, creates transportation problems, especially in public conveyances, such as buses, trains, airplanes, etc.

SUMMARY OF THE INVENTION

Underlying the present invention is the objective of devising an improved surfboard or aquaplane of the above-mentioned type whose hull consists of at least two hull sections which are separable from one another for transportation purposes and which can be joined together to form a stable hull structure of no less rigidity than a comparable unitary hull.

In order to attain the above objective, the present invention suggests that the hull of the surfboard or aquaplane be provided with at least one transverse separation joint and that the separable hull sections can be joined in a torsion resistant connection, whereby, according to a further feature of the invention, this connection is obtained through a longitudinal clamping force holding the hull sections against each other.

According to another advantageous feature of the invention, the sectional hull encloses, as a part thereof, at least one spine tube which extends longitudinally through each hull section. Inside the spine tube, or tubes, is arranged a clamping cable whose one end is attached to one end section of a hull, while the opposite cable end is attached to a suitable tensioning buckle engaging the other end section of the hull.

In a preferred embodiment of the invention, the sectional hull has two horizontally spaced tubes extending therethrough, the spine tubes being separably joined in the area of the hull separation joints, whereby special connecting sleeves engage the spine tube extremities on both sides of the separation joints. The longitudinal sections of the two spine tubes, thus centered and connected to each other, assure that the hull sections, when connected at their joints and longitudinally tensioned by means of the cables, form an integral hull construction which is stable and non-yielding to torsion stress at its transverse joints.

The proposed sectional hull structure has several advantages: The separability of the hull into several short hull sections is advantageous for various transportation situations, especially in connection with public transportation means. The tension applied to the hull sections by means of the tensioning cables inside the spine tubes increases the stability of the hull in comparison to similar one-piece hulls, thereby improving the navigational characteristics of the vessel. The operations necessary for assembly and disassembly of the novel hull, as well as the application of the aforementioned longitudinal tension involve few and inexpensive structural elements and very simple operative steps, so that the proposed sectional hull can be manufactured at very reasonable costs. Lastly, the separate sections of the novel hull are easy to store in a home or apartment and are also easier to handle during production and shipment, as well as storage in retail outlets.

BRIEF DESCRIPTION OF THE DRAWING

Further special features and advantages of the invention will become apparent from the description following below, when taken together with the accompanying drawing which illustrates, by way of example, a preferred embodiment of the invention, represented as follows:

The sole figure in the drawing shows, in an exploded perspective view, a surfboard or aquaplane equipped with a sail for wind propulsion, representing an embodiment of the present invention.

DESCRIPTION OF THE PREFERRED EMBODIMENT

The wind-propelled surfboard or windsurfer, depicted in the drawing, includes a plastic hull 1 which, in the present example, is subdivided into three hull sections 1*a*, 1*b*, and 1*c*. As the drawing implies, these hull sections can be longitudinally joined together at two transverse separation joints. The central hull section further includes a downwardly extending daggerboard keel 2, and the rear hull section 1*c* carries a downwardly extending stabilizing fin 3. On the upper side of the central section 1*b*, ahead of the position of the keel 2, is further arranged a mast 4 which is attached to the body of the hull section by means of a foot connection 5. The latter includes a universal pivot allowing the mast to be inclined with respect to the sectional hull at any angle and/or orientation.

The mast 4 carries a generally triangular sail 6, the luff of the sail being preferably in the form of a hollow seam inside which the mast 4 is receivable. As is clearly shown in the drawing, the mast itself may likewise be composed of several longitudinal sections — three in the present embodiment — with appropriate male and female connecting elements giving the assembled mast a stable, more or less rigid structure. A generally horizontal batten 7 extends rearwardly from approximately mid-height of the mast 4, at the level of the junction between the rising foot and the downwardly sloping leech of the sail 6, the batten 7 extending a distance beyond the rear corner of the sail.

At its forward extremity the batten 7 is pivotably connected to the mast 4 by means of a gooseneck 8, while the rear extremity of the batten 7 carries a curry cleat, or some other suitable rope cleat. On the mast 4 is further mounted a generally arcuate vang tube 10 from which two sheets 11 and 12 extend rearwardly to the cleat 9. The sheets 11 and 12, which thus define a rearwardly pointing horizontal triangle, leave enough space for the sail 6 to deflect laterally under wind pressure.

A downhaul in the form of a short sheet 13 attached to the luff of said 6, provides the desired luff tension by engaging an eyelet 14 at the bottom end of the mast 4. An outhaul 15 attached to the bottom end of the leech of sail 6 and engaging a suitable eyelet of the batten 7 provides a means for adjusting the leech tension of the sail.

Through the length of the three hull sections 1*a*, 1*b*, and 1*c* extend two spine tubes 16, being spaced apart horizontally to the extent permitted by the shape of the hull 1. The separability of the three hull sections requires, of course, that the spine tubes are likewise separable at the separation joints, as will be described further below. The two spine tubes 16 accommodate inside of them two tensioning cables 17 of which the forward extremity is permanently attached to the bow section 1*a* in any suitable manner. The rear extremities of the two tensioning cables 17 are attachable to a pair of tensioning buckles 18, by means of appropriate cable loops and hooks, for example. The tensioning buckles 18 preferably include threaded tensioning bolts engaging the stern section 1*c* of the hull, thereby pulling the stern section of the hull against its bow section and against its intermediate center section, subjecting the hull 1 to a longitudinal clamping force which, in conjunction with the spine tubes 16, gives the assembled hull considerable rigidity and resistance against twisting and separation at its separation joints.

In order to safely prevent any torsional separation at the hull joints, the latter further include connecting sleeves 19 engaging the adjacent extremities of the spine tubes 16 in each separation joint of the hull 1. For this purpose, the extremities of the spine tubes 16 have appropriately recessed bores, each accommodating about one-half of the length of a connecting sleeve 19.

As will be readily apparent from the drawing and from the foregoing description, the assembly and the disassembly of the sectional hull involve few and very simple operative steps for which no special training is necessary. The hull, in its disassembled state, greatly facilitates transportation and stowage of the apparatus, in addition to other, earlier-mentioned advantages of manufacture and handling.

It should be understood, of course, that the foregoing disclosure describes only a preferred embodiment of the invention and that it is intended to cover all changes and modifications of this example of the invention which fall within the scope of the appended claims.

I claim the following:

1. A windsurfing vessel, such as a surfboard or aquaplane equipped with a sail, the apparatus comprising in combination:

an elongated vessel hull capable of supporting a rider thereon, the vessel hull having at least one transverse separation joint along which it is separable into a plurality of longitudinally adjoining hull sections;

a mast extending upwardly from a midportion of the hull, being attached thereto by means of a universal joint;

a sail carried by the mast, including rigging means attached to said mast and sail, respectively, for converting wind in the sail into motive power on the vessel body, in response to manual adjustment of the sail and mast position by the rider;

at least two hollow spine members extending longitudinally through at least a major portion of the hull's length and across its separation joints, the spine members being likewise longitudinally separable at each separation joint of the hull;

means for releasably attaching the hull sections to one another, to form a substantially rigid structural assembly, said section attaching means including tensioning cables extending through the hollow spine members; and means for rotationally interlocking the adjoining hull sections at the separation joints.

2. A windsurfing vessel as defined in claim 1, further comprising:

means for tensioning said tensioning cables, so as to apply a longitudinal clamping force to the hull sections, said cable tensioning means being defined by one end of each cable and by one end section of the hull, while the opposite ends of the tensioning cables are attached to the other hull end section.

3. A windsurfing vessel as defined in claim 2, wherein:

the spine members are spine tubes and are laterally spaced apart inside the vessel hull;

each spine tube is separable into adjoining tube sections at each separation joint of the vessel hull; and said rotational interlocking means is defined by the spine tubes.

4. A windsurfing vessel as defined in claim 3, wherein:

the vessel hull has two separation joints, being accordingly composed of three hull sections: a bow section, a center section, and a stern section;

the spine tubes extend a distance into the bow section, through the center section, and through the stern section; and the tensioning cables, running inside the spine tubes, are fixedly attached to the bow section, the cable tensioning means including tensioning buckles engaging the stern section.

5. A windsurfing vessel as defined in claim 4, wherein:

the center section of the hull carries the mast and has a daggerboard keel extending from its underside; and the stern section of the hull has a stabilization fin extending from its underside.

* * * * *